US010588440B1

(12) United States Patent
Kajgana

(10) Patent No.: US 10,588,440 B1
(45) Date of Patent: Mar. 17, 2020

(54) DELIVERY BOX BUILT IN GARAGE DOOR

(71) Applicant: Zarko Kajgana, Camas, WA (US)

(72) Inventor: Zarko Kajgana, Camas, WA (US)

( * ) Notice: Subject to any disclaimer, the term of this patent is extended or adjusted under 35 U.S.C. 154(b) by 0 days.

(21) Appl. No.: 16/501,143

(22) Filed: Feb. 25, 2019

(51) Int. Cl.

| | |
|---|---|
| ***A47G 29/28*** | (2006.01) |
| ***E06B 3/58*** | (2006.01) |
| ***A47G 29/20*** | (2006.01) |
| *E06B 3/70* | (2006.01) |
| *A47G 29/12* | (2006.01) |

(52) U.S. Cl.
CPC ..... *A47G 29/28* (2013.01); *A47G 29/20* (2013.01); *E06B 3/5892* (2013.01); *A47G 29/12* (2013.01); *E05Y 2900/106* (2013.01); *E06B 2003/7044* (2013.01)

(58) Field of Classification Search
CPC ..... A47G 29/28; A47G 29/12; A47G 29/14; A47G 29/16; A47G 2029/144; A47G 2029/148; A47G 29/124; A47G 29/20; E06B 3/5892; E06B 2003/7044; E06B 7/32; E05Y 2900/106; E05G 7/005
USPC .... 232/19, 43.1, 43.4, 43.5, 44, 45, 31, 1 E; 109/67, 68; 220/345.1, 345.2, 476; 49/68
See application file for complete search history.

(56) References Cited

U.S. PATENT DOCUMENTS 845,964 A * 3/1907 Mittendorf ..... G07F 9/06 232/1 R
914,528 A * 3/1909 Thinnes ..... B65F 1/12 232/43.5
952,173 A * 3/1910 Zitko ..... B60N 3/083 220/477
1,840,561 A * 1/1932 Bre Miller ..... B65B 3/006 220/810
2,829,820 A * 4/1958 Evers ..... A47G 29/1223 232/19
5,368,226 A * 11/1994 Franceschino ..... A47G 29/1223 232/19
5,492,272 A * 2/1996 Fewer ..... A47G 29/12 232/19
5,730,296 A 3/1998 Limmer
6,302,325 B1 * 10/2001 Alexander ..... E05C 7/002 109/68
6,651,876 B2 * 11/2003 Scott ..... E05B 65/0841 109/67
6,719,195 B2 4/2004 Farentinos
7,240,823 B1 * 7/2007 Saidiazar ..... A47G 29/12 232/19
8,485,424 B1 * 7/2013 Taylor ..... A47G 29/12095 232/47
9,016,558 B2 * 4/2015 Alexander ..... E06B 7/32 109/67
9,371,681 B2 6/2016 Tompkins
(Continued)

*Primary Examiner* — William L Miller
(74) *Attorney, Agent, or Firm* — Howard Russell

(57) ABSTRACT

To prevent the theft of packages and increase the reliability and security of delivered packages from consignor to a consignee, it is necessary to create a secured delivery box built into a garage door. The delivery box built in garage door includes an opening in garage door, built in housing with sliding lid, or pivoting lid, on input opening. The housing has one or two output openings on a sides or bottom. Also, the housing of the delivery box has an optionally sloped floor on either a single side or both sides, or flat floors, or rolling conveyor floor or a ball rolling conveyor floor.

12 Claims, 9 Drawing Sheets

(56) References Cited

U.S. PATENT DOCUMENTS

| | | | | |
|---|---|---|---|---|
| 9,963,930 | B1 * | 5/2018 | Reisender | E06B 7/32 |
| 2002/0070269 | A1 * | 6/2002 | Rosiello | A47G 29/12 232/19 |
| 2004/0181570 | A1 | 9/2004 | Kaneko | |
| 2009/0184159 | A1 * | 7/2009 | Crawford | A47G 29/12 232/19 |
| 2014/0008246 | A1 | 1/2014 | Pfeiffer | |
| 2017/0143146 | A1 * | 5/2017 | Charbeneau | A47G 29/141 |
| 2018/0199745 | A1 * | 7/2018 | Charbeneau | A47G 29/141 |
| 2018/0317687 | A1 * | 11/2018 | Crooks | A47G 29/12 |

* cited by examiner

Section "X-X"

Section "X-X"

Section "X-X"

Section "X-X"

DELIVERY BOX BUILT IN GARAGE DOOR

BACKGROUND

The invention relates to a delivery box built into a garage door to securely accept and receive packages from the consignor to the consignee, preventing the potential of theft and the risk of an intruder gaining access to the garage or home, and to safely store delivered packages. Packages are commonly placed at the front of the home at the entrance to the house or the garage, which raises the risk of theft and the packages going missing. Compared with existing patents (e.g. 20110084123A1, Apparatus for secure postal and parcel receipt and storage), the present invention is a simpler design which is less costly to built and implement, and easier to bring to market. It also has the ability to accept larger packages, having a greater storage capacity.

SUMMARY OF THE INVENTION

The present invention provides a reliable and secure method for the delivery of mail and large packages.

The opening on the front side of the housing has a sliding or pivoting lid to prevent influx of rain or snow. The housing floor has a flat or sloped floor on one or both sides of housing to improve the sliding of packages once inserted upon delivery.

The housing includes a floor and may include an upper portion having a back wall and side walls. This provides the ability to prevent an intruder gaining access to the garage or home.

The rim of the housing may have an attached bin bolted around the input opening of the garage door.

BRIEF DESCRIPTION OF THE DRAWINGS

Various embodiments of the invention are disclosed in the following detailed description and accompanying drawings.

DETAILED DESCRIPTION

Figure 1:
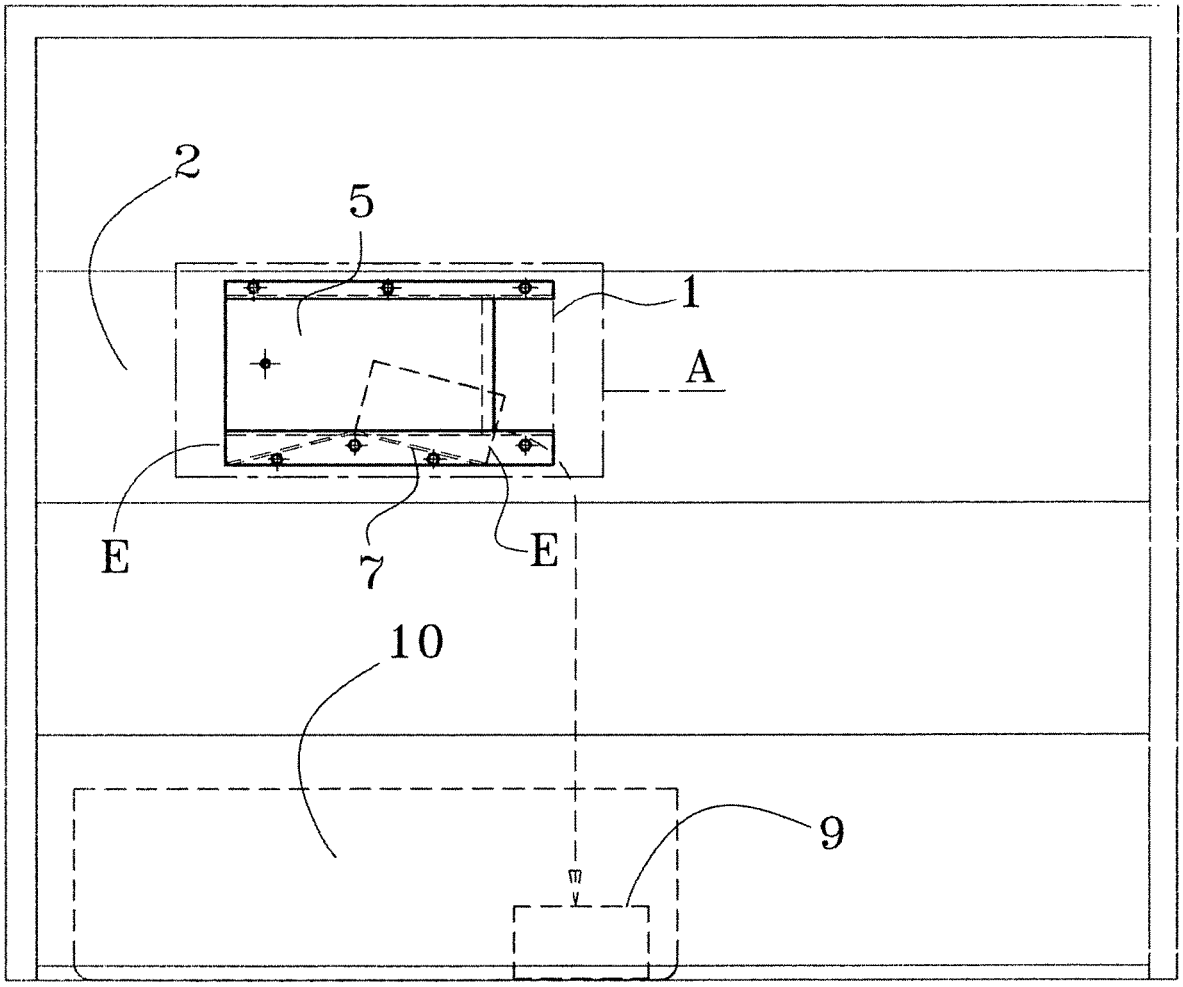
FIG. 1 illustrates a plane view of the delivery box built in to the third panel of a typical garage door (the most desirable location), in which the housing has a sloped floor on both sides towards the output, with the possibility of a flat floor, a sloped floor on one side, or sloped floors with conveyors.

FIG. 1 illustrates a plane view of detail "A" of the delivery box with a sliding lid 5 built in to the third panel (most preferable location) of the garage door 2, in which the housing 1 has a sloped floor 7 on both sides towards the output openings E for a delivered package 9 into the collection box 10.

Figure 2:
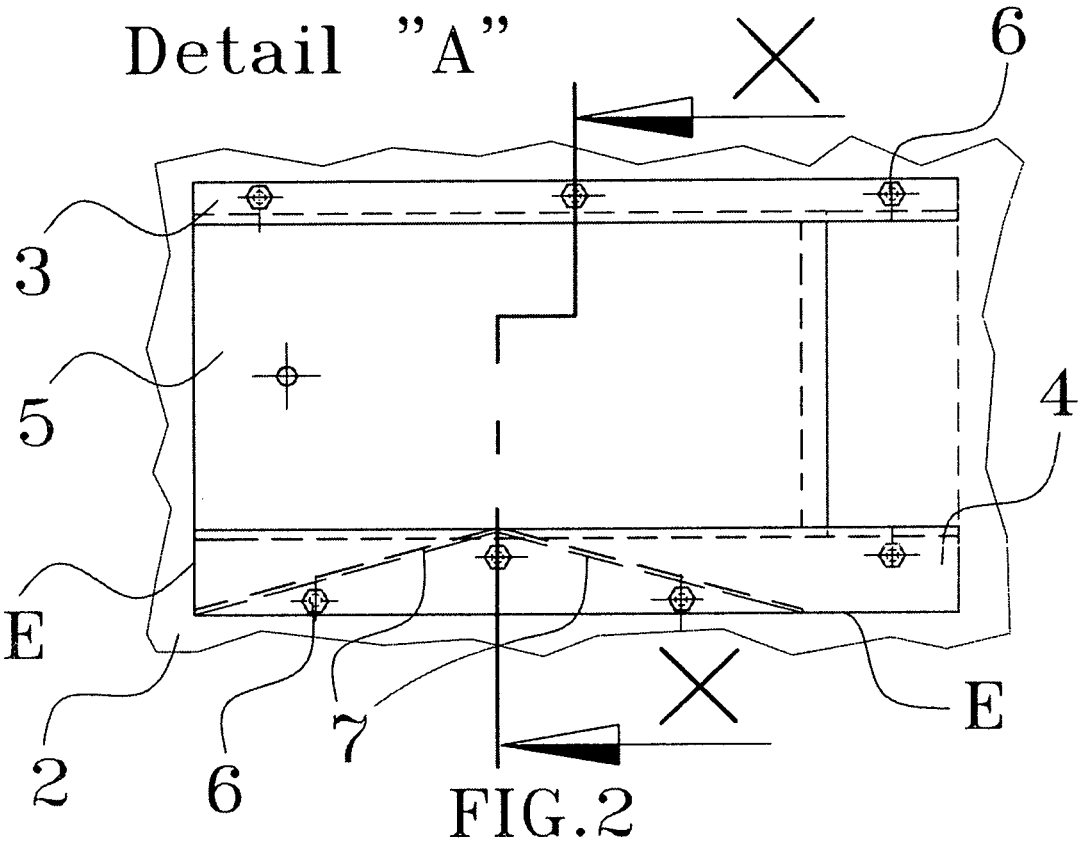
FIG. 2 illustrates detail "A" of the housing of the delivery box with sloped floor on both output sides.

FIG. 2 illustrates detail "A" of the delivery box with a sliding lid 5 on the input side T, located along guiding bars 3 and 4, bolted onto the panel of the garage door 2, with bolts 6 and the sloped floor 7 on left and right towards output opening E.

Figure 2A:
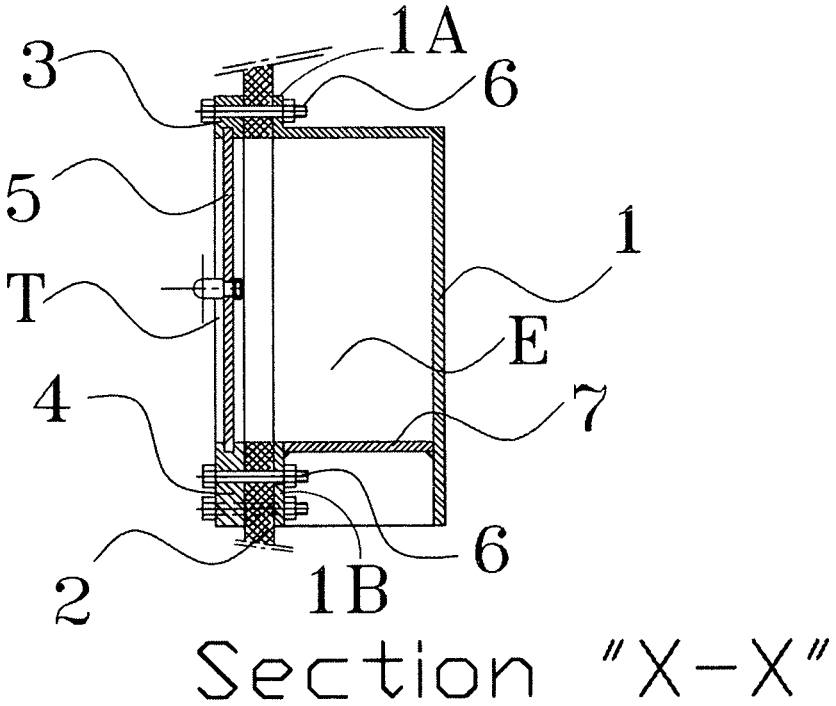
FIG. 2A illustrates section "X-X" of detail "A" of the housing with an output opening and a sliding lid on the input side with guiding bars, bolted on the garage door.

FIG. 2A illustrates section "X-X" of the delivery box detail "A" with a sloped floor 7, and a sliding lid 5 on the input opening T which is located along the guiding bars 3 and 4, and the housing 1 with rims 1A and 1B. Also illustrated is the bin with bolts 6 bolted onto the panel of the garage door 2.

Figure 3:
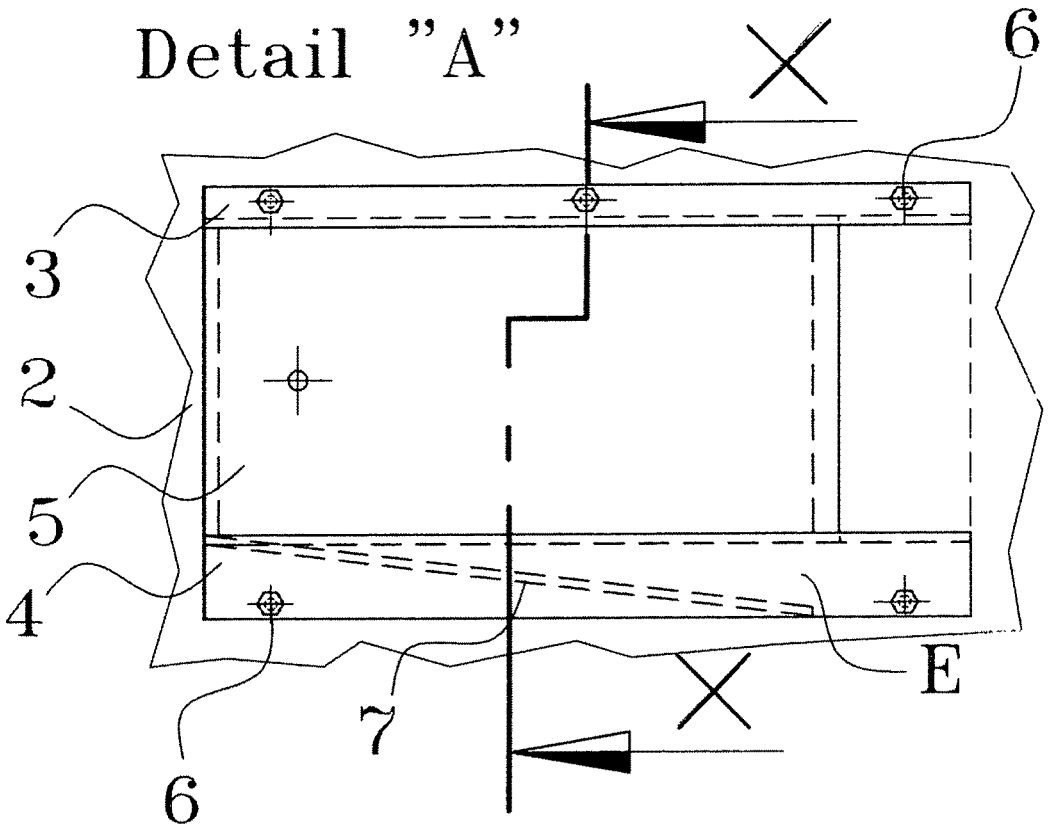
FIG. 3 illustrates detail "A" of the housing, the delivery box with a sloped floor on one output side.

FIG. 3 illustrates detail "A" of the delivery box with a sliding lid 5 on the input side T, located along guiding bars 3 and 4, bolted on the panel of the garage door 2 with bolts 6, and also illustrates the sloped floor 7 towards output opening E.

Figure 3A:
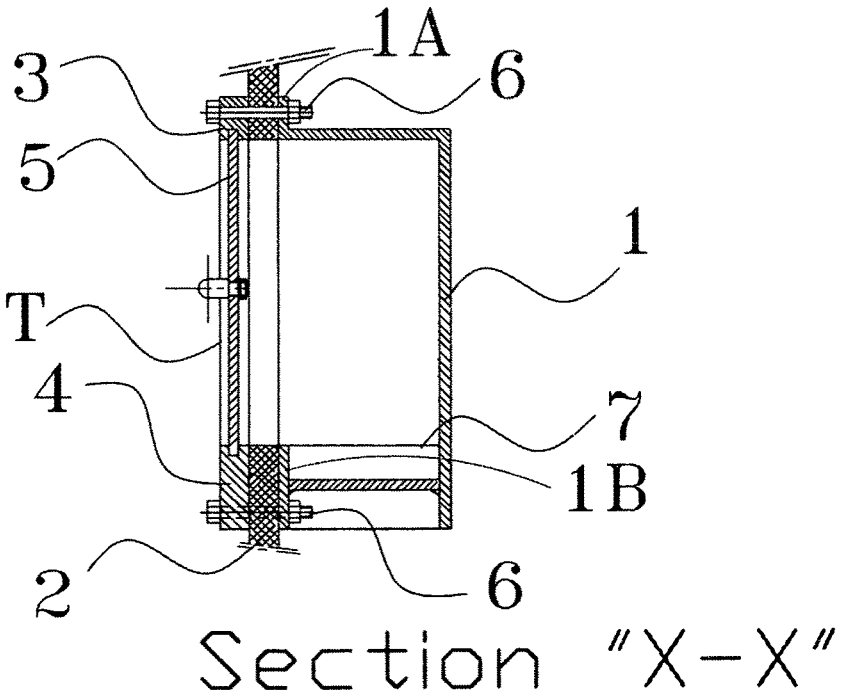
FIG. 3A illustrates section "X-X" of detail "A" of the housing with an output opening and sliding lid on the input side located in the guiding bars, bolted on the garage door.

FIG. 3A illustrates section "X-X" of delivery box detail "A" with a sloped floor 7, and a sliding lid 5 on the input side T which is located along guiding bars 3 and 4, and the housing 1 with rim 1A and 1B. Also illustrated is the bin bolted with bolts 6 onto the panel of the garage door 2.

Figure 4:
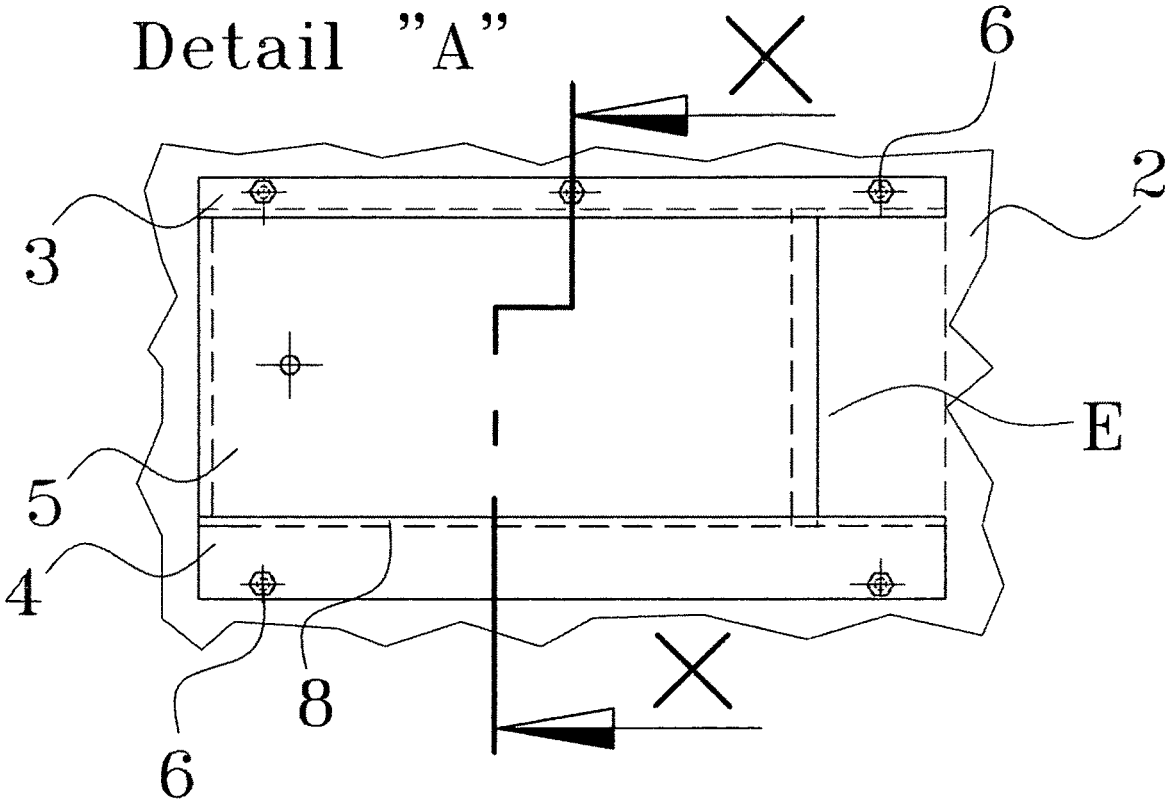
FIG. 4 illustrates detail "A" of the housing of the delivery box with a flat floor with possibly one or two output openings on the housing.

FIG. 4 illustrates detail "A" of the delivery box with a sliding lid 5 on the input side T, located along guiding bars 3 and 4, bolted onto the panel of the garage door 2 with bolts 6 and illustrates a flat floor 8 and output opening E.

Figure 4A:
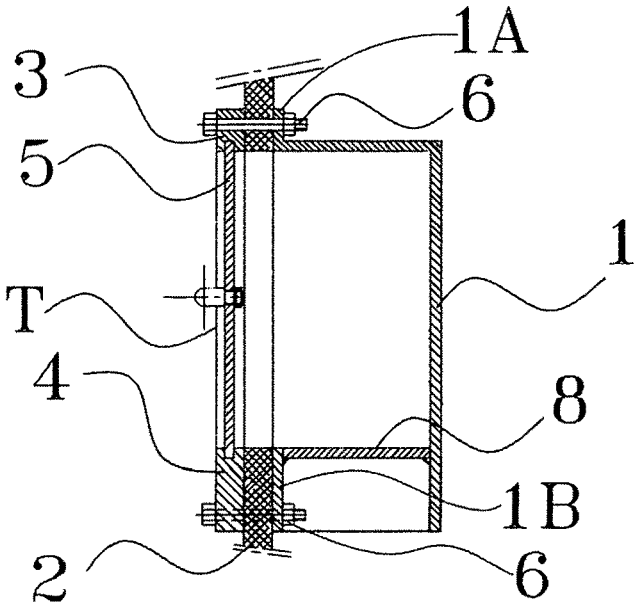
FIG. 4A illustrates section "X-X" of detail "A" of the housing of the delivery box with a flat floor with guiding bars bolted on garage door.

FIG. 4A illustrates section "X-X" of delivery box detail A with a flat floor 8, and a sliding lid 5 on the input opening T, which is located along guiding bars 3 and 4, and the housing 1 with rims 1A and 1B. Also illustrated is the bin with bolts 6 bolted onto the panel of the garage door 2.

Figure 5:
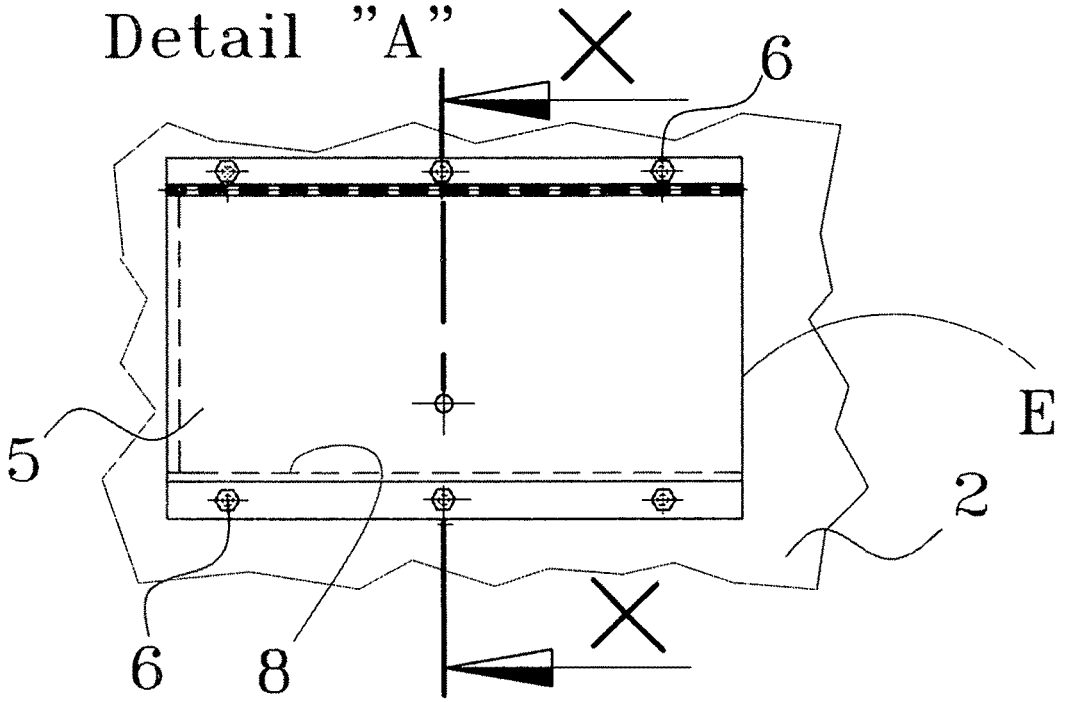
FIG. 5 illustrates detail "A" of the housing of the delivery box with a flat floor and a pivoting lid on the input side of the device.

FIG. 5 illustrates delivery box detail "A" with a pivoting lid 5 on the input side T, bolted onto the panel of the garage door 2 with bolts 6. Also illustrated is a flat floor 8 and output opening E.

Figure 5A:
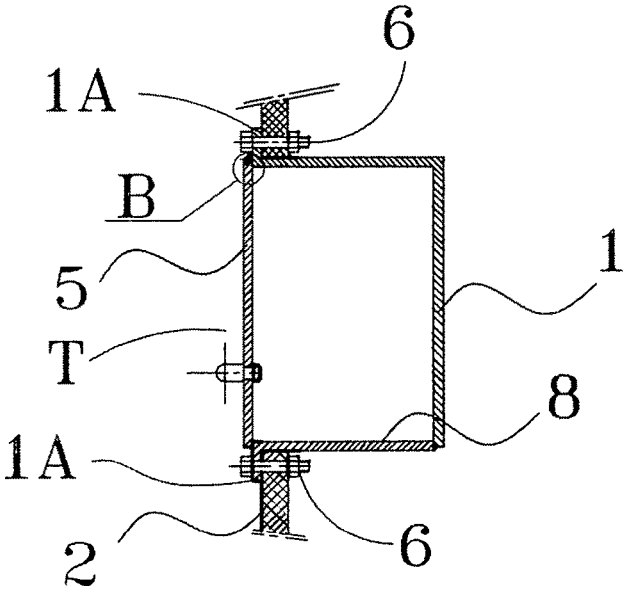
FIG. 5A illustrates section "X-X" of detail "A" with a pivoting lid bolted to the housing on the garage door.
Figure 5B:
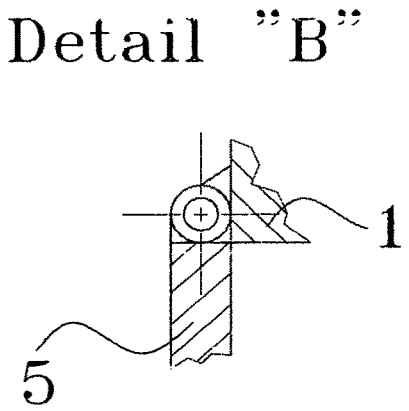
FIG. 5B illustrates an enlarged detail "B" showing the pivoting lid bolted onto the housing.

FIG. 5A illustrates section "X-X" of the delivery box detail "A" with a flat floor 8, and a pivoting lid 5 on the input side T, adjacent to the housing 1 with rim 1A. Also illustrated is the bin with bolts 6 bolted onto the panel of the garage door 2. FIG. 5B illustrates enlarged detail 'B" of the pivoting lid 5 and housing 1.

Figure 6:
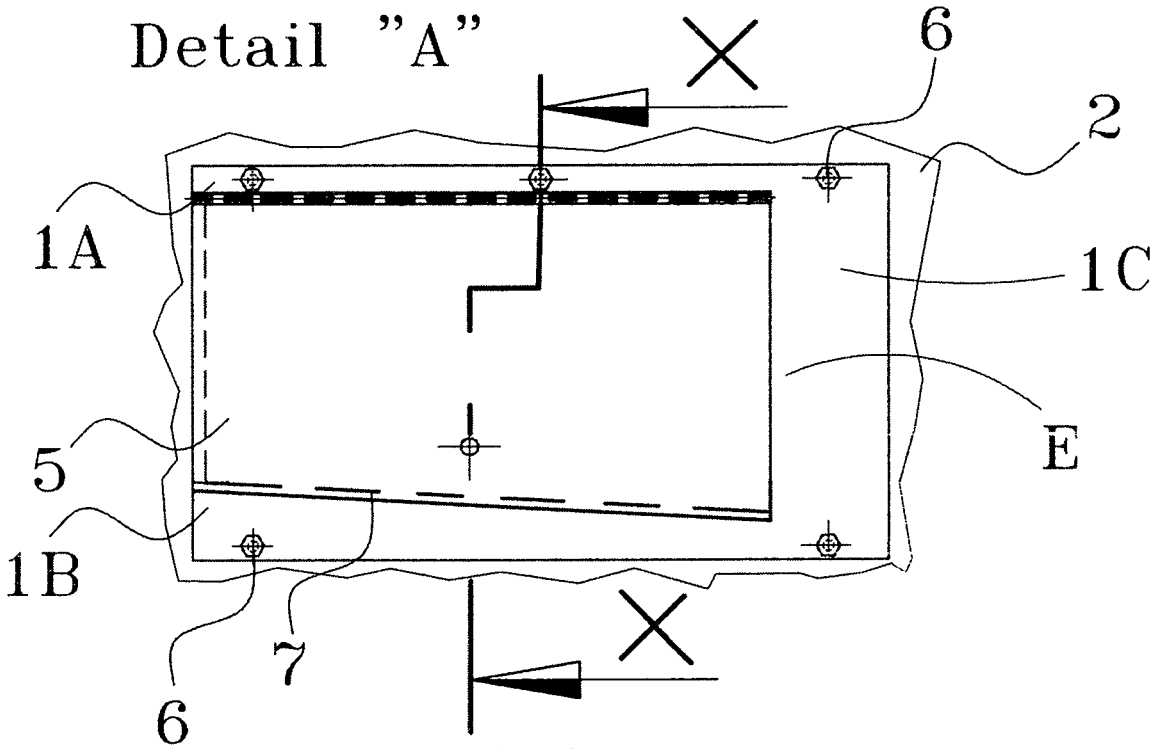
FIG. 6 illustrates detail "A" of the housing of the delivery box on one output side with a sloped floor and a pivoting lid on input side.

FIG. 6 illustrates delivery box detail "A" with a pivoting lid 5 on the input side T, bolted onto the panel of the garage door 2 with bolts 6, and illustrates a sloped floor 7 and output opening E.

Figure 6A:
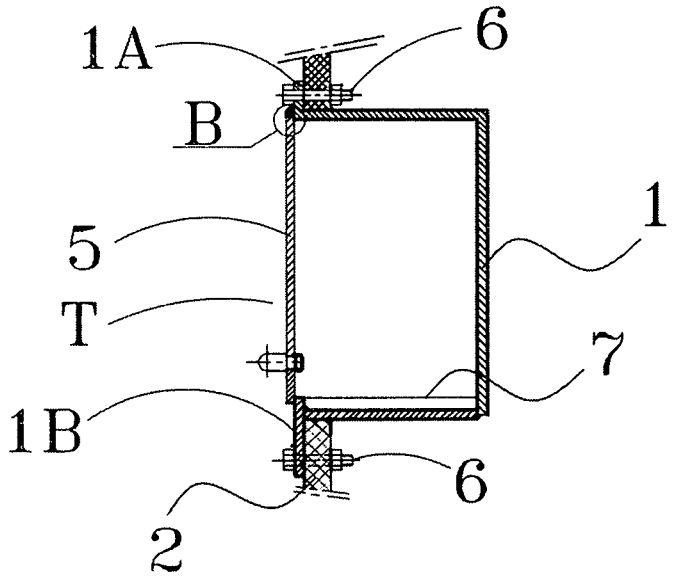
FIG. 6A illustrates section "X-X" of detail "A" with a pivoting lid on the input side, with the housing bolted onto the garage door.
Figure 6B:
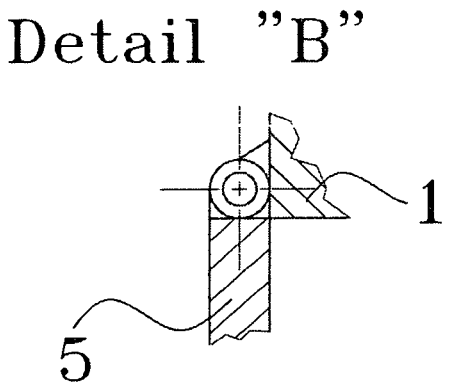
FIG. 6B illustrates enlarged detail "B" of the pivoting lid and attached housing.

FIG. 6A illustrates section "X-X" of delivery box detail "A" with a sloped floor 7, and a pivoting lid 5 on the input side T, with the housing 1 and rims 1A, 1B, and 1C. Also illustrated is the bin with bolts 6 bolted onto the panel of the garage door 2. FIG. 6B illustrates an enlarged display of detail "B" of the pivoting lid 5 and the housing 1.

Figure 7:
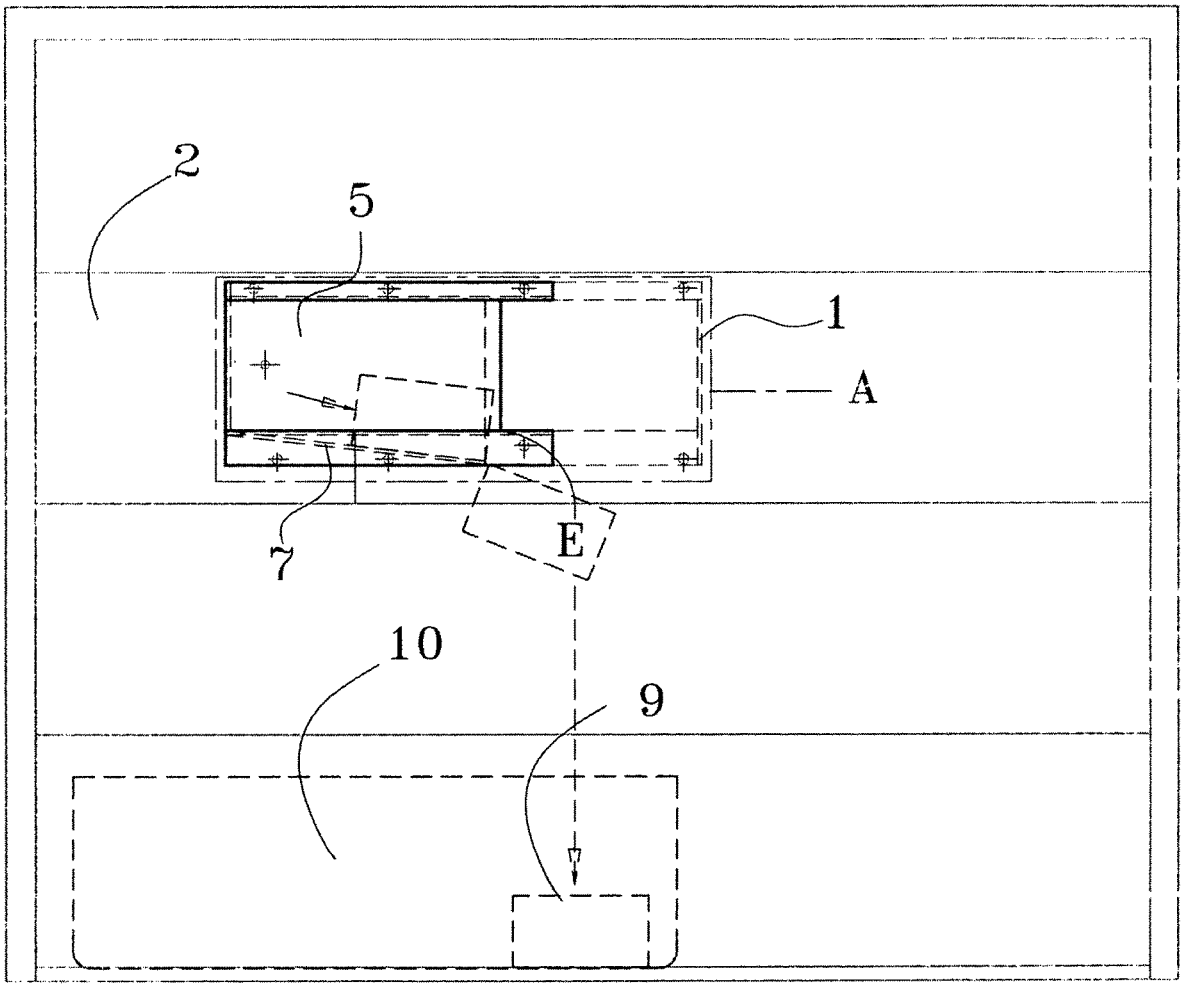
FIG. 7 illustrates a plane view of the delivery box built into the third panel from the ground of the garage door, with a housing having a sloped floor on one side directed toward the output. It may also include a flat floor, sloped floors with conveyors, and may have a closed wall on left, right, back and top side.

FIG. 7 illustrates a plane view of detail "A" of the delivery box with a sliding lid 5. It is preferably built into the third panel of the garage door 2, with the housing 1 with a floor 7 sloped towards the output opening E for delivering packages 9 into the collection box 10.

Figure 8:
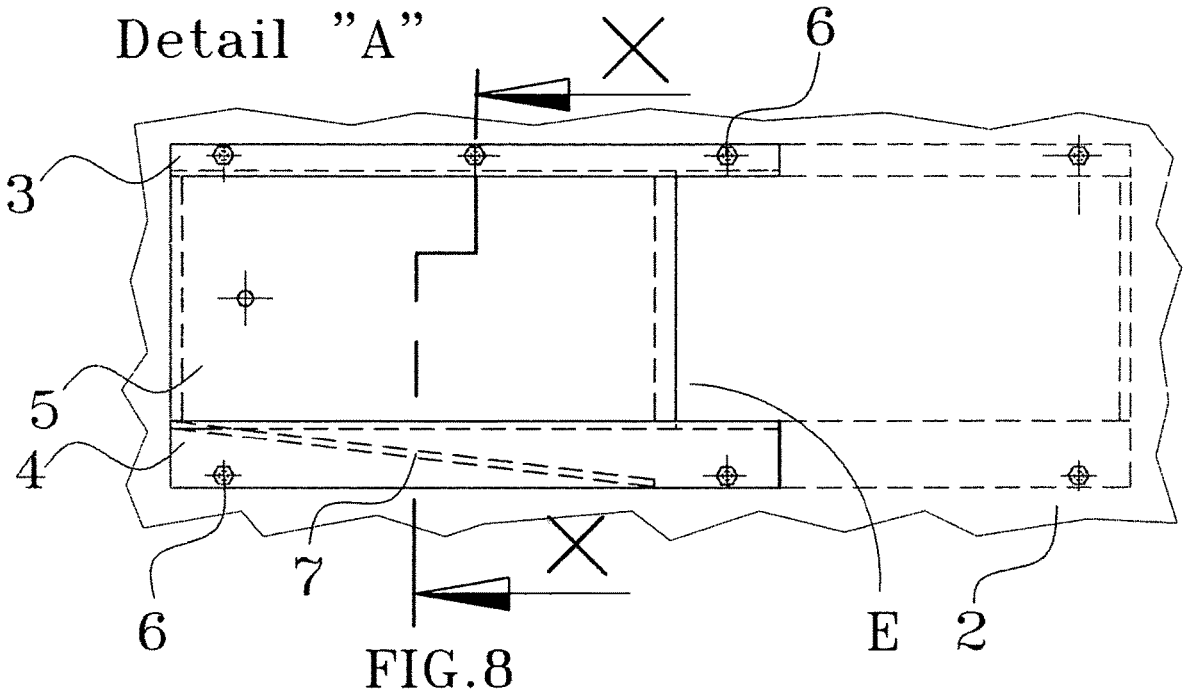
FIG. 8 illustrates detail "A" of the housing delivery box with a sliding lid on the input side and possibly a pivoting lid, with sloped floors towards the output opening, with a closed wall on the left, right, back and top side.

FIG. 8 illustrates a plane view of detail "A" of the delivery box with a sliding lid 5 on the input side T, preferably built into the third panel of the garage door 2, with the housing 1 having a sloped floor 7 towards the output opening E. The housing 1 may have enclosed walls except for the input side T and output side E.

Figure 8A:
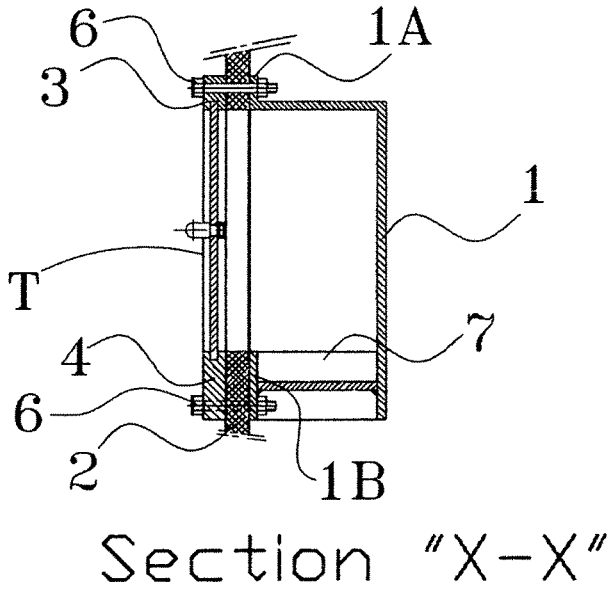
FIG. 8*a* illustrates section "X-X" of detail "A" of the delivery box assembly, bolted onto the garage door together with the guiding bars, sliding lid and housing.

FIG. 8A illustrates section "X-X" of detail "A" of the delivery box with a sloped floor 7, a pivoting lid 5 on the input opening T, and the housing 1 with rim 1A and 1B, the bin bolted with bolts 6 onto the panel of the garage door 2.

Figure 9:
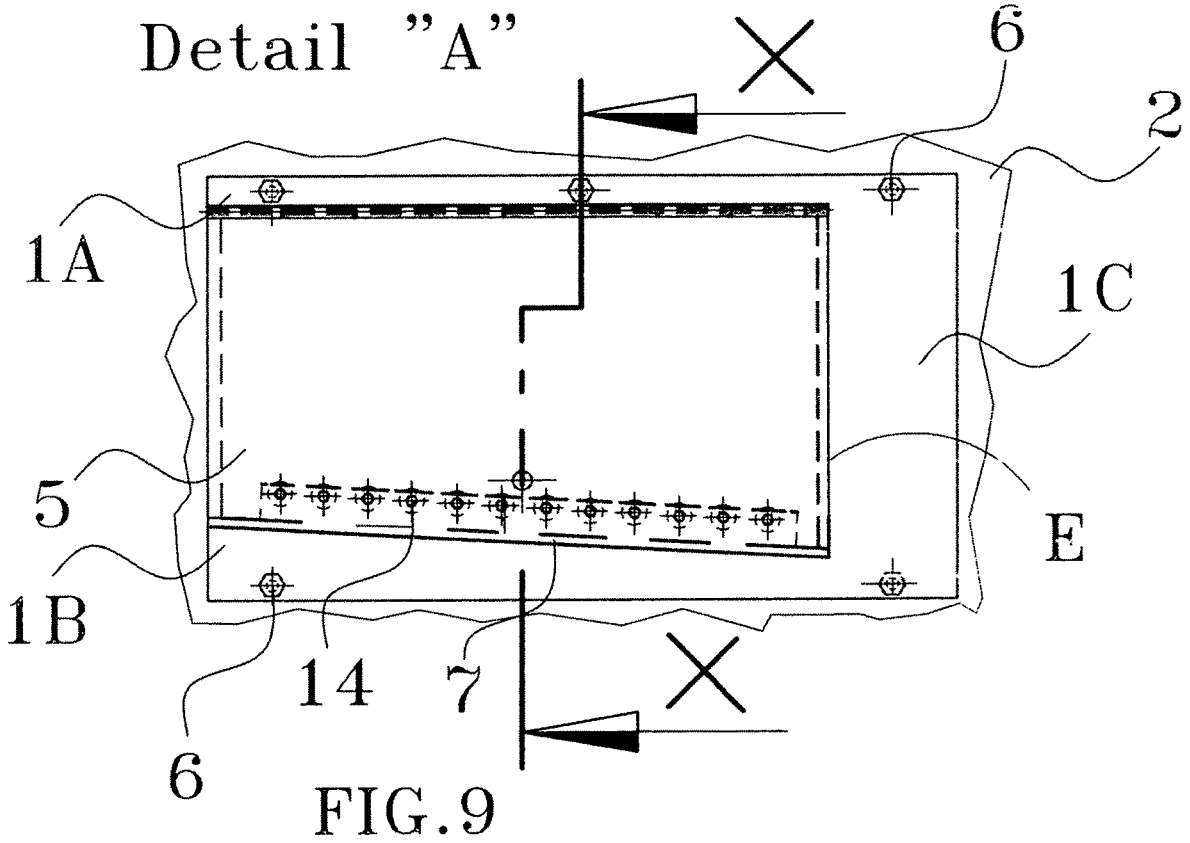
FIG. 9 illustrates detail "A" of the housing of delivery box with a pivoting lid on the input side which has a sloped floor towards the output opening with rolling conveyors, possibly with ball rolling conveyors.

FIG. 9 illustrates section "X-X" of the delivery box detail "A" with a pivoting lid 5 on the input opening T, with the housing 1 having a sloped floor 7 and rolling conveyors 14, with rim 1A, 1B, and 1C. The device is illustrated with the bin bolted with bolts 6 onto the panel of the garage door 2.

Figure 9A:
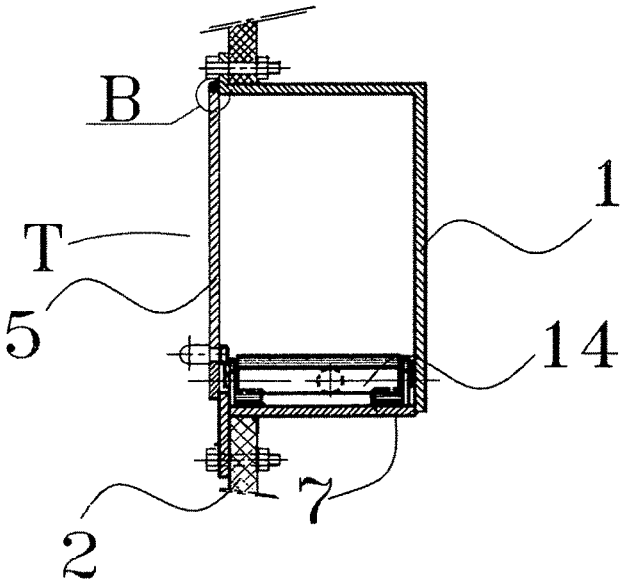
FIG. 9A illustrates section "X-X" of detail "A" of the delivery box assembly with a pivoting lid and rolling conveyor or possibly with a ball rolling conveyor.

FIG. 9A illustrates section "X-X" of detail "A" of the delivery box assembly, with a pivoting lid 5 and a rolling conveyor 14 or possibly with a ball rolling conveyor.

Figure 9B:
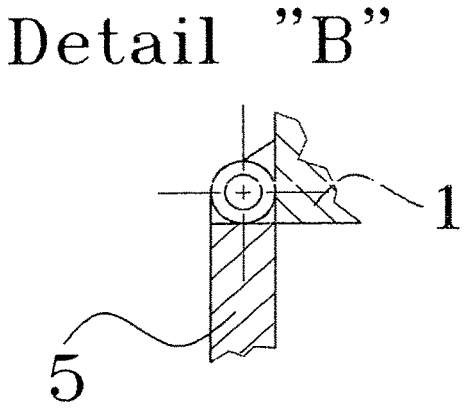
FIG. 9B illustrates enlarged detail "B" of the pivoting lid and bolted housing.

FIG. 9B illustrates enlarged detail "B" of the pivoting lid 5 and the housing 1.

What is claimed is:

1. A secured delivery device built into a garage door comprising:

at least a bottom portion, and an output opening;

an access door located on the front of the device;

a first guiding bar attaching the device to the garage door with a first set of bolts; and a second guiding bar attaching the device to the garage door with a second set of bolts;

wherein said device secures against access by an intruder to the garage or a package once inserted upon delivery by said bottom portion having at least one surface being slanted downwardly towards the output opening such that upon delivery the package is moved to a location remote to the access door to prevent access by an intruder to the package upon delivery, further comprising a rolling conveyor located on said at least one surface of said bottom portion.

2. The secured delivery device of claim 1 wherein said bottom portion has two said surfaces, each said surface slanted downwardly towards the ground in opposite directions to facilitate movement of the package to a location remote to the access door to prevent access by an intruder to the package upon delivery, wherein there is a rolling conveyor located on each said surface.

3. The secured delivery device of claim 1 wherein each guiding bar comprises a track thereby defining a sliding track on the exterior of the garage door, and wherein said access door is adapted to slide within said sliding track.

4. A secured delivery device built into a garage door comprising:

a container having a bottom portion, a back portion, and an output opening;

an access door located on the front of the device opposite of said back portion of said container;

a first guiding bar attaching the container to the garage door with a first set of bolts; and a second guiding bar attaching the container to the garage door with a second set of bolts;

wherein said bottom portion of the container is slanted downwardly towards the output opening such that upon delivery the package slides to a location remote to the access door to prevent access by an intruder upon delivery of the package.

5. The secured delivery device of claim 4 wherein each guiding bar comprises a track thereby defining a sliding track on the exterior of the garage door, and wherein said access door is adapted to slide within said sliding track.

6. The secured delivery device of claim 4 further comprising a hinge on the exterior of the garage door, wherein said access door is adapted to pivot on said hinge.

7. A secured delivery device adapted to be installed at the location of an opening on a garage door comprising:

at least a bottom portion, and an output opening;

an access door adapted for installation at an outside location of the garage door opening and adjacent the front of said device when installed on the garage door;

a first guiding bar adapted for attaching the device to the garage door with a first set of bolts; and a second guiding bar adapted for attaching the device to the garage door with a second set of bolts, wherein said bottom portion of the device is slanted downwardly towards the output opening such that upon delivery the package slides to a location remote to the access door to prevent access to the package by an intruder, further comprising a rolling conveyor located on said bottom portion that is downwardly slanted.

8. The secured delivery device of claim 7 wherein each guiding bar comprises a track thereby defining a sliding track on the exterior of the garage door, and wherein said access door is adapted to slide within said sliding track.

9. The secured delivery device of claim 7, wherein the device comprises a container having said bottom portion, said output opening, and a back portion opposite said access door, and wherein said output opening is adapted for transfer of a delivered package to a location remote to the access door to prevent access to the package by an intruder upon delivery of the package.

10. A secured delivery device adapted to be installed at the location of an opening on a garage door comprising:

at least a bottom portion, and an output opening;

an access door adapted for installation at an outside location of the garage door opening and adjacent the front of said device when installed on the garage door;

a first guiding bar adapted for attaching the device to the garage door with a first set of bolts; and a second guiding bar adapted for attaching the device to the garage door with a second set of bolts, wherein said bottom portion of the device has two surfaces, each said surface being slanted downwardly towards the ground in opposite directions to facilitate movement of the package to a location remote to the access door to prevent access by an intruder to the package upon delivery.

11. The secured delivery device of claim 10 further comprising a rolling conveyor located on each said surface that is downwardly slanted of said bottom portion of the device.

12. The secured delivery device of claim 10, wherein the device comprises a container having said bottom portion, said output opening, and a back portion opposite said access door, and wherein said output opening is adapted for transfer of a delivered package to a location remote to the access door to prevent access to the package by an intruder upon delivery of the package.

* * * * *